United States Patent [19]

Barvinek et al.

[11] Patent Number: 4,897,960

[45] Date of Patent: Feb. 6, 1990

[54] RAILROAD CROSSING GATE

[75] Inventors: Todd A. Barvinek; James W. Jensen, both of Linn County, Iowa

[73] Assignee: General Signals, Inc., Evansville, Iowa

[21] Appl. No.: 292,928

[22] Filed: Jan. 3, 1989

[51] Int. Cl.[4] ..... E01F 13/00; E05D 15/52

[52] U.S. Cl. ..... 49/49; 49/192; 49/237

[58] Field of Search ..... 49/49, 9, 35, 192, 237

[56] References Cited

U.S. PATENT DOCUMENTS

| | | | |
|---|---|---|---|
| 1,665,043 | 1/1928 | Blackwell | 49/237 X |
| 1,996,196 | 4/1935 | Ferris | 49/237 X |
| 2,352,310 | 6/1944 | Brown et al. | 49/237 X |
| 2,401,275 | 5/1946 | Richards et al. | 49/237 X |
| 2,874,493 | 2/1959 | Mandel | 49/9 X |
| 3,024,550 | 3/1962 | Kudera, Jr. et al. | 49/192 X |
| 4,124,955 | 11/1978 | Kochis | 49/237 |
| 4,364,200 | 12/1982 | Cobb | 49/192 |

*Primary Examiner*—Philip C. Kannan

*Attorney, Agent, or Firm*—James C. Nemmers

[57] ABSTRACT

An improved crossing gate for railroad grade crossings. The gate is constructed of an impact-resistant material, and the crossing arm is mounted so that it will swing out of the way and return to its original position if struck by a moving vehicle from either direction. The crossing arm also contains protected lighting that will withstand impact, and provision is made to permit easy replacement of burned-out light bulbs.

5 Claims, 4 Drawing Sheets

FIG 1
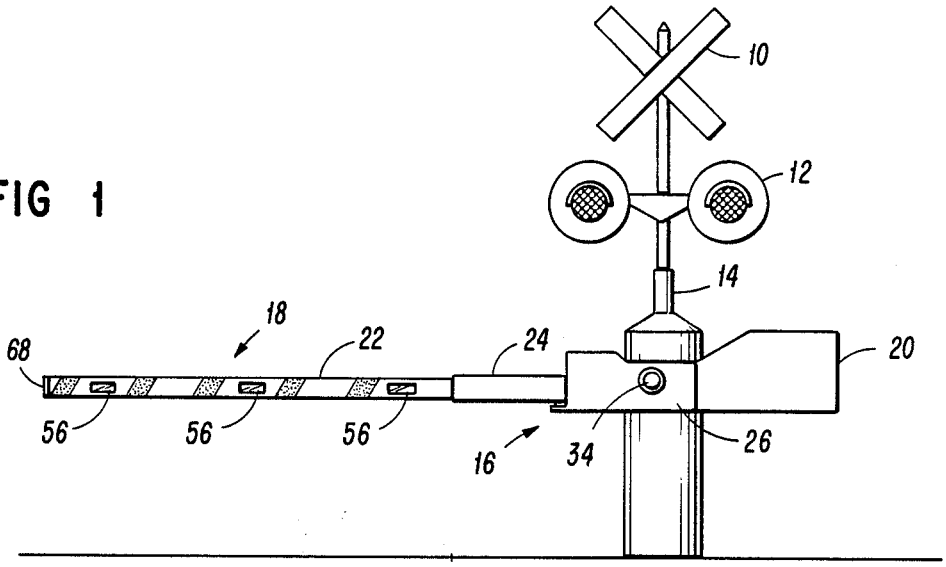
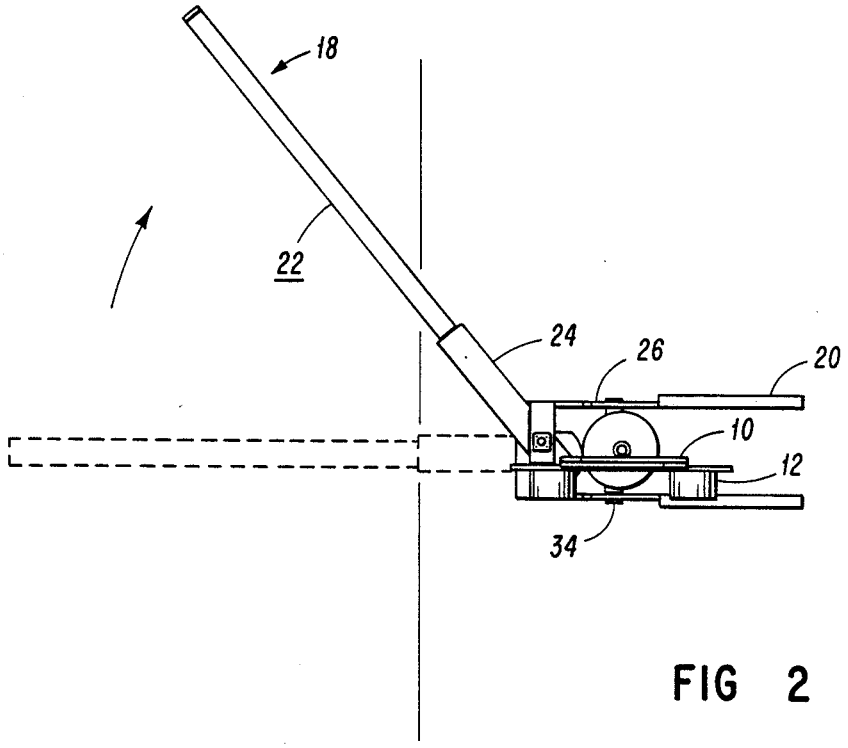
FIG 2

RAILROAD CROSSING GATE

BACKGROUND OF THE INVENTION

This application is a substitute for U.S. Ser. No. 795,910 filed Nov. 7, 1985 which application is now abandoned.

A rather sizeable expense for railroads is the maintenance of grade crossings that are provided with crossing gates, since it is not uncommon for vehicles to drive through the crossing even though the crossing gate is down blocking the crossing. This of course usually results in the crossing arm being damaged or broken and needing repair or replacement. Railroads thus incur a substantial expense in repairing these crossing gates, and more importantly a railroad can be held liable for an accident that occurs at the grade crossing because a damaged or broken crossing gate has not been promptly repaired. The resulting liability can be substantial. It is therefore extremely important that crossing gates be repaired or replaced as soon as possible. Merely learning that a crossing gate has been damaged can be a practical problem.

To avoid the expense and potential liability resulting from damaged crossing gates, it would therefore be highly desirable if a crossing gate could be designed that would be practically indestructible while still providing the function of blocking the grade crossing and warning motorists of an oncoming or passing train. A crossing gate that would survive impact of a vehicle from either direction and remain operable so as to serve its warning function would greatly reduce the cost of replacing and repairing crossing gates, and more importantly, would greatly reduce the potential liability of railroads that fail to immediately repair damaged crossing gates.

SUMMARY OF THE INVENTION

The improved crossing gate of the invention is mounted so that it will operate in the manner of the conventional crossing gate in that it is pivotally mounted so as to move from an upright position in which the grade crossing is not blocked to a down position in which the arm of the crossing gate extends across the grade crossing in a substantially horizontal position. However, the arm of the crossing gate of the invention is mounted so that it can swing in a substantially horizontal plane if struck by a vehicle moving in either direction. The arm itself is made of an impact resistant material so that it can withstand without damage impact from a vehicle moving at a high rate of speed. An added feature of the invention is that the required lighting is mounted inside of the crossing arm so that it will be protected and it can withstand impact from vehicles and also minimize any damage from vandals. The crossing gate of the invention also allows the gate to be swung out of the road area thus permitting maintenance or repair to be conducted safely.

BRIEF DESCRIPTION OF THE DRAWINGS

FIG. 1 is an elevational view illustrating a crossing gate at a grade crossing and showing the crossing arm in a down or warning position;

FIG. 2 is a top or plan view of the crossing gate and illustrating horizontal movement of the crossing arm;

DESCRIPTION OF THE PREFERRED EMBODIMENT OF THE INVENTION

Figure 3:
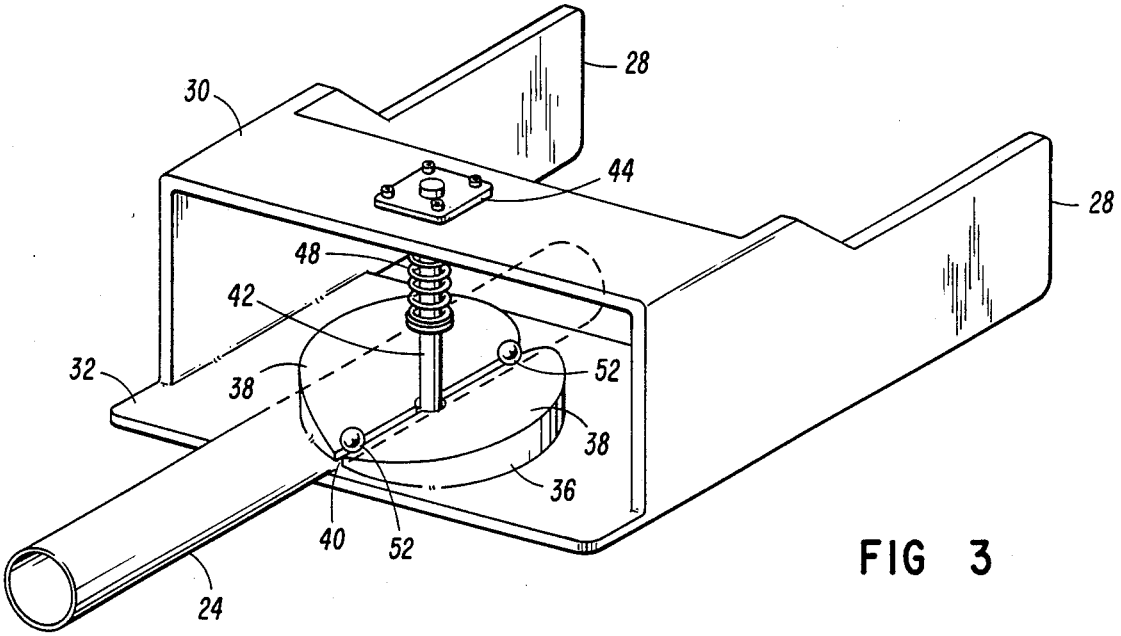
FIG. 3 is a perspective view of a portion of the mounting of the crossing arm.
Figure 4:
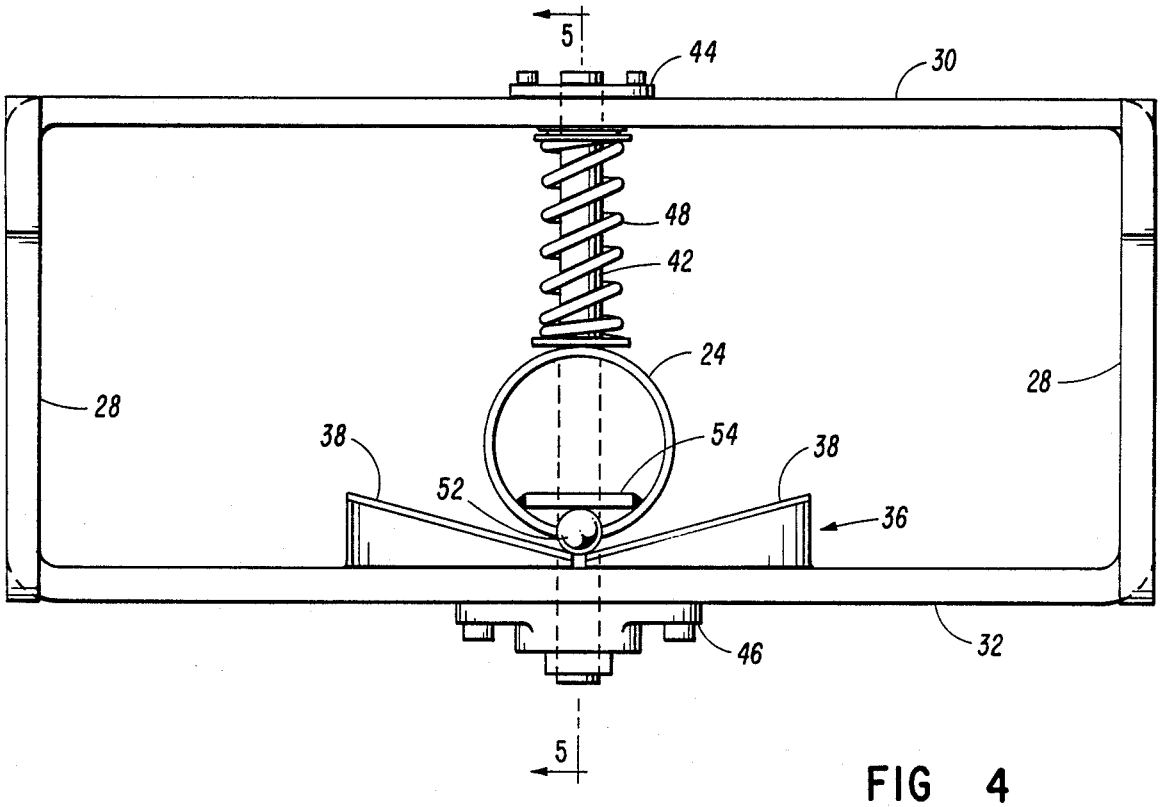
FIG. 4 is an end elevational view of the mounting of the crossing arm.

In FIG. 1, there is illustrated a railroad crossing warning system that includes the familiar crossed warning sign 10, beneath which there is positioned a pair of flashing warning lights 12, all mounted on a vertical support 14. On most grade crossings, there is also included a moveable crossing gate, indicated generally by the reference numeral 16, which is actuated automatically by a train approaching the grade crossing. As is well known, the crossing gate 16 is normally in an upright position allowing vehicles to freely cross the railroad tracks at the grade crossing, but when actuated by an oncoming train, the crossing gate is lowered to a position blocking the grade crossing, as shown in FIG. 1. When the crossing gate is in the position shown in FIG. blocking the grade crossing, vehicles approaching the crossing are supposed to stop, being warned by the warning sign 10, the flashing warning lights 12 and the crossing gate. However, not infrequently, vehicles are driven, either intentionally or inadvertently, through the grade crossing when the crossing gate is in the down position resulting in the crossing gate being damaged to the extent that it cannot provide a proper warning thereafter. Frequently, the arm extending across the roadway at the grade crossing is broken completely off. The crossing gate of the invention resolves this problem in the manner described hereinafter.

Referring first again to FIG. 1, the crossing gate includes an arm 18 extending outwardly from the vertical support 14. Arm 18 is pivotally mounted on or near the vertical support 14 so as to be normally moveable upwardly or downwardly in a vertical plane to block the road when actuated by an approaching train. The conventional crossing gate also includes a counterbalancing mechanism 20 that assists in raising and lowering the arm 18.

Referring now to FIGS. 2–6, the mounting of the crossing arm 18 so as to practically eliminate damage to it when struck by a vehicle will now be described. The arm 18 consists of an outer member 22 that extends across the roadway of the grade crossing. Outer member 22 is a hollow, elongated member of any desired cross-sectional shape and made of impact resistant material, such as polycarbonate, so that the outer member 22 will have sufficient rigidity and yet withstand the tremendous impact that occurs if the outer member 22 is struck by a moving vehicle.

Outer member 22 is supported at its inner end by having its inner end held inside of a tubular support 24 that is preferably made of a rigid, strong material such as steel or aluminum. The inner end of tubular support 24 extends inside of a housing 26 having parallel vertical side walls 28 joined by a top wall 30 and a bottom wall 32. The inner ends of the side walls 28 provide a mounting through which a pivot 34 extends to permit the entire crossing gate 16 to move upwardly and downwardly in a general vertical plane. On the upper surface of bottom wall 32 there is mounted a camblock 36 that provides a pair of inclined surfaces 38 extending upwardly and outwardly from the center generally transversely to the longitudinal axis of the tubular support 24. At the juncture of the inclined surfaces 38 there is formed along a line generally parallel with the longitudinal axis of tubular support 24 a groove 40.

Figure 5:
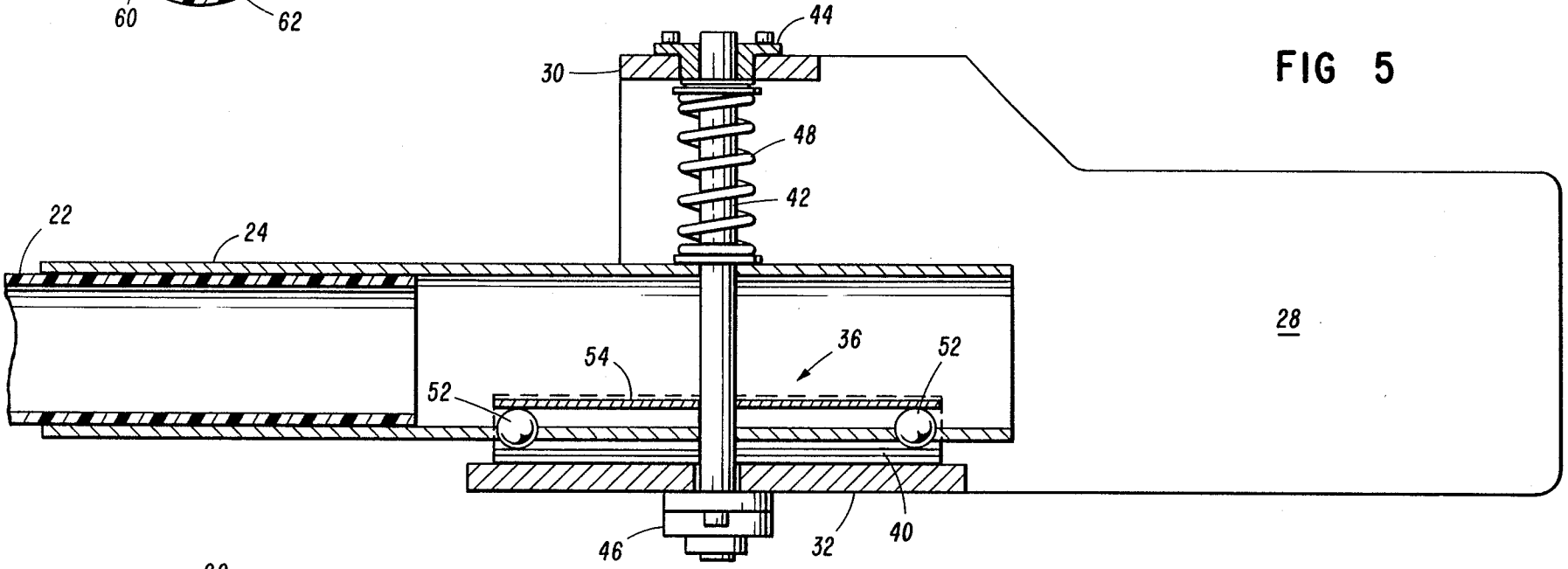
FIG. 5 is a side elevational view, mostly in section, and showing the crossing arm mounting.

A vertical retaining pin 42 extends upwardly through the center of the camblock 36, and is secured by suitable fasteners 44 to the top wall 30. Retaining pin 42 is also secured by appropriate fastening means 46 to the bottom wall 32. The retaining pin 42 extends through the tubular support 24, and a coil spring 48 positioned between a pair of retaining washers 50 surrounds the upper part of the retaining pin 42, with the lower washer 50 engaging the top of the tubular support 24 to bias the tubular support 24 in to a nesting position on the camblock 36. As best seen in FIGS. 3 and 5, a pair of ball bearings 52 are positioned in the lowest surface of the tubular support 24 along a line parallel to the longitudinal axis of the tubular support 24. The ball bearings 52 are retained in place by a retaining plate 54 secured by welding or other appropriate means to the inside surfaces of the tubular support 24. The ball bearings 52 are positioned so that they extend slightly outwardly from the outer surface of tubular support 24 and so that they normally will rest in the groove 40 of the camblock 36. The ball bearings 52 are normally biased into the groove 40 by action of the coil spring 48 which exerts a force on the tubular support 24 as previously described.

With the foregoing described construction, arm 18 will normally be held in the position of the dotted lines of FIG. 2, perpendicular to the roadway. However, if struck, arm 18 will move in a horizontal plane to allow the vehicle to pass through the crossing without breaking the arm 18.

Figure 5A:
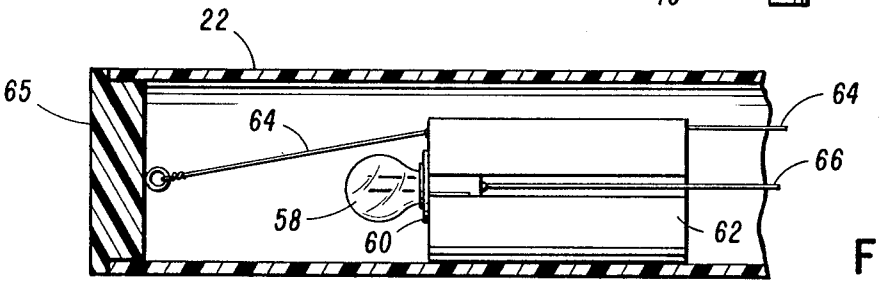
FIG. 5*a* is a sectional view of a portion of the outer end of the crossing arm and illustrating the mounting of the warning lights.
Figure 7:
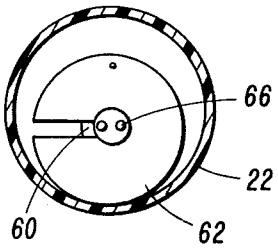
FIG. 7 is an end sectional view of the crossing arm tube to further show the mounting of the warning lights.
Figure 6:
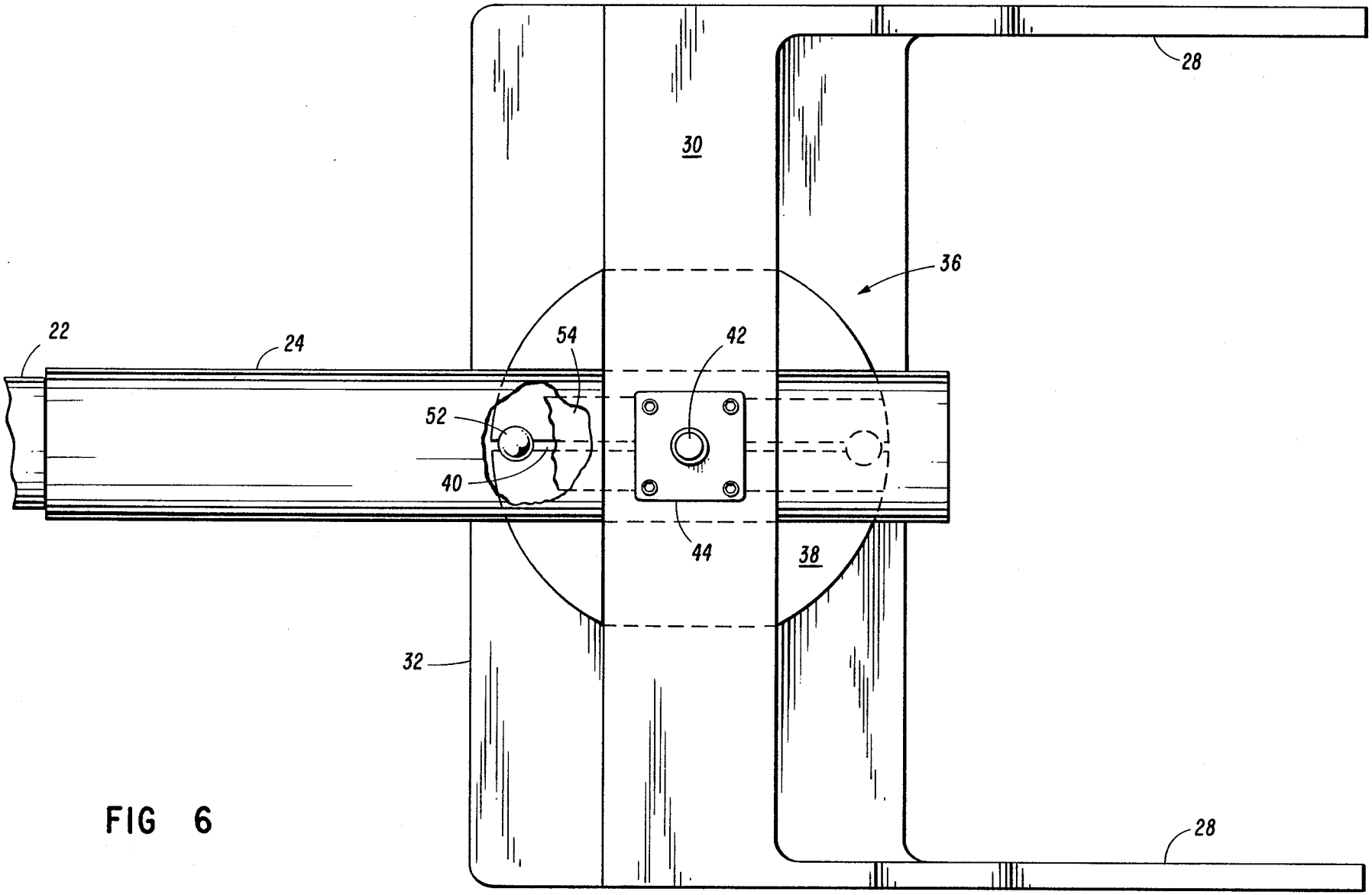
FIG. 6 is a top plan view of the mounting of the crossing arm with a portion broken away for clarification.

Regulations and safety require that the ar 18 be clearly visible at night, and contain a required minimum number of lights. Thus, the arm is commonly provided with high visibility tape that is visible both at night and day, and preferably has some reflective properties. The lighting customarily is mounted on the top of the crossing arm, which makes the lighting unprotected in the event that the crossing arm 18 is struck. These lights are also susceptible to breaking by vandalism. In the invention, and as is customary, the arm 18 can be covered with any type of desired reflective tape in any desired pattern, but the lighting is protected in that it is contained inside of the outer member 22 of arm 18. As indicated in FIG. 1, the outer member can be provided with openings 56 at the desired spaced intervals, which openings can be covered by a red plastic that is also impact resistant. Positioned behind each of the openings 56 is a light bulb 58 (See FIG. 5*a*) seated in a suitable electrical socket 60 seated in a cushioning member 62 that floats freely inside the outer member 22. The members 62 are interconnected by a cord 64 which is secured to a cap 65 in the end of member 22. Cushioning members 62 are preferably of a material that is lightweight, such as one of the foamed plastics. The wiring 66 interconnecting the sockets 60 is also contained inside of the cushioning member 62 and is connected to a power source in any suitable manner (not shown) inside of the housing 26 or vertical support 14. How this is done is not shown since this is well within the skill of the art since a power supply ill be provided for the warning lights 12.

With the lighting system of the invention, the light bulbs 58 are protected from direct impact if the arm 18 is struck by a moving vehicle, and the lighting system is also shielded and cushioned by the members 62 which are free to move inside of the impact resistant outer member 22. When a light bulb 58 needs replacing, the cap 65 on the outer end of the member 22 can be removed, and by disconnecting the cord 64 at its inner end (and the electrical connection as well), the members 62 holding the bulbs can be pulled out the outer end of tube 22 and a bulb 58 replaced. With this arrangement, the light bulbs 58 are not only cushioned from direct impact, but they are weather protected and easy to replace. It has been our experience that bulbs will survive impact of a vehicle striking the arm 18 even though the vehicle is traveling at a high rate of speed.

Operation of the crossing gate of the invention will now be described. The crossing gate operates in a conventional manner in that when an approaching train triggers the automatic actuating mechanism, the flashing lights 12 will be actuated and the arm 18 lowered to a position blocking the crossing. The arm 18 will remain in this position until the train has passed the grade crossing, at which time, through well known conventional means, the system will be actuated to move the crossing arm upwardly out of the way of the grade crossing where it remains in its normally retracted position until another oncoming train approaches the crossing. With the crossing arm of the invention, if a vehicle (or vandals) strike the crossing arm 18, the impact resistant material of the outer member 22 will not break or crack but will flex slightly. In addition, a sufficient force exerted on the arm 18 will overcome the resistance of the coil spring 48 and permit the arm 18 to move in a horizontal plane by pivoting about the vertical retaining pin 42 driving the balls 52 up the inclined surfaces 38. As the balls 52 are moved up the inclined surfaces 38, the spring 48 will be compressed and will apply an increased amount of force downwardly against the tubular support 24, and will force the balls 52 back down the inclined surfaces 38 into the groove 40, thus returning the arm 18 to its original position perpendicular to the grade crossing. Because of the design of the camblock 36, the same action will occur if the crossing arm 18 is struck by a vehicle traveling from either direction. We have found that the crossing arm will withstand impact of vehicles traveling as high as 70 miles an hour without damage to the crossing arm, and in each instance, the crossing arm will immediately return to the proper position perpendicular to the grade crossing so as to warn any subsequent motorists.

The crossing arm of the invention thus practically eliminates replacement and repair of crossing arms. The crossing arm is relatively simple, has few parts that require no maintenance, and it can be installed on existing supporting structure at a relatively low cost. The construction not in any way interfere with the normal, conventional operation of the crossing gate and will make maintenance and repair safer. Also, as previously described, the lighting system for the crossing arm will greatly minimize damage to the lights resulting not only in decreased maintenance costs, but more importantly, assuring that the proper warning will almost always be given.

It will be obvious to those skilled in the art that various revisions and modifications can be made to the preferred embodiment disclosed herein. It is our intention that all such revisions and modifications as are obvious to those skilled in the art will be included within the scope of the following claims.

WHAT IS CLAIMED IS AS FOLLOWS:

1. A crossing gate for selectively blocking vehicular traffic across a railroad grade crossing, said crossing gate comprising: means for mounting said crossing gate for movement in a generally vertical plane from an upright position not blocking the crossing to a lowered position blocking the crossing, an arm extending outwardly from the mounting means in a direction generally perpendicular to the direction of movement of the vehicular traffic, means combined with said arm and said mounting means and providing for swingable movement of said arm from a position blocking the crossing when force is applied to the arm and providing for return of the arm to its original position blocking the crossing when the force is removed, said arm having at least one translucent portion, means for providing light located inside of the arm behind the translucent portion, and a cushion support for the light providing means.

2. The crossing gate of claim 1 in which the cushion support is suspended inside of the arm so as to freely float inside of the arm.

3. A crossing gate for selectively blocking vehicular traffic across a railroad grade crossing, said crossing gate comprising: means for mounting said crossing gate for movement in a generally vertical plane from an upright position not blocking a crossing to a lowered position blocking the crossing, an arm extending outwardly from the mounting means in a direction generally perpendicular to the direction of movement of the vehicular traffic, the outer potion of said arm being made of an impact-resistant and somewhat flexible material, a supporting base having surfaces inclined upwardly and outwardly from a groove aligned with the arm and supporting the inner end of the arm with the inner end normally resting in the groove, a vertical pivot extending through the inner end of the arm and the supporting base to provide for swingable movement of the arm from a position blocking the crossing when force is applied to the arm, means normally biasing the inner end of the arm into the groove of the supporting base with the inclined surfaces providing resistance to swingable movement of said arm from its normal position blocking the crossing, and friction reducing means between the arm and the inclined surfaces of the supporting base to facilitate movement of the inner end of the arm up and down the inclined surfaces when force is applied to the arm in a direction generally perpendicular to the vertical plane of the arm's movement.

4. The crossing gate of claim 3 in which the means normally biasing the inner end of the arm into the groove includes a spring around the vertical pivot and engaging the upper surface of the inner end of the arm.

5. The crossing gate of claim 4 in which the friction reducing means includes a pair of ball bearings, one on each side of the vertical pivot, the ball bearings normally resting in the groove in the supporting base.

* * * * *